United States Patent [19]

Revis

[11] 4,393,666

[45] Jul. 19, 1983

[54] BALANCED HEAT EXCHANGE ASSEMBLY

[76] Inventor: Doyle A. Revis, 9864 Monroe Dr., Dallas, Tex. 75220

[21] Appl. No.: 196,614

[22] Filed: Oct. 14, 1980

[51] Int. Cl.[3] ..... F25B 27/02

[52] U.S. Cl. ..... 62/506; 62/238.6

[58] Field of Search ..... 165/174; 62/506, 238.6

[56] References Cited

U.S. PATENT DOCUMENTS

| | | | |
|---|---|---|---|
| 2,762,209 | 9/1956 | Bennett | 165/134 |
| 2,968,934 | 1/1961 | Komedera | 62/506 |
| 3,131,553 | 5/1964 | Ross | 62/506 |
| 4,287,724 | 9/1981 | Clark | 165/184 |

*Primary Examiner*—William R. Cline
*Assistant Examiner*—John F. McNally
*Attorney, Agent, or Firm*—Dennis T. Griggs

[57] ABSTRACT

A heat exchange assembly for reclaiming heat energy from the refrigerant of an air conditioning system comprises a plurality of tube-in-tube heat-exchange coils each adapted to receive the refrigerant and the flow of water through respective tubes in counterflow for heat exchange therebetween. Inlet and outlet manifold pipes connect the coils to the refrigerant circulation circuit and said manifold pipes have graduations of internal cross-sectional area to ensure substantially equal rates of flow of refrigerant through each coil.

1 Claim, 2 Drawing Figures

BALANCED HEAT EXCHANGE ASSEMBLY

FIELD OF THE INVENTION

The present invention relates to heat exchange assemblies for use in reclaiming thermal energy from refrigerant fluid of an air conditioning system.

DESCRIPTION OF THE PRIOR ART

Previous proposals in this art envisage the extraction of heat from the refrigerant prior to its passing to the compressor of the air conditioning system and transfer of the extracted heat to water in a hot water supply system. The extraction and transfer are achieved using coiled-tube heat exchangers. However, in order to obtain sufficient heat transfer, it is necessary to employ a plurality of heat exchange coils. In the prior art construction, the operation of the coils in uneven and an upstream one of the coils suffers a much greater flow rate of refrigerant than the other coils. This results in the working temperature of that coil being considerably higher than the others, leading to excessive wear of that particular coil.

It is an object of the present invention to provide a novel construction of heat exchange assembly for reclaiming heat from the refrigerant of an air conditioning system.

It is a further object to provide a heat exchange assembly for such use in which uneven working of heat exchange coils is avoided.

SUMMARY OF THE INVENTION

According to the invention a heat exchange assembly for reclaiming heat from the refrigerant of an air conditioning system comprises a water circulation circuit and a refrigerant circulation circuit each connected to a plurality of tube-in-tube heat exchange coils. Means are provided for ensuring substantially equal rates of flow of the refrigerant through each coil.

The means preferably include refrigerant inlet and outlet connection manifolds of graduated cross-sectional area to balance the refrigerant flow therethrough.

These and other features of the invention will become apparent from the following description of the preferred embodiment of the invention, which is, however, offered by way of example only.

DETAILED DESCRIPTION OF THE PREFERRED EMBODIMENT

Figure 1:
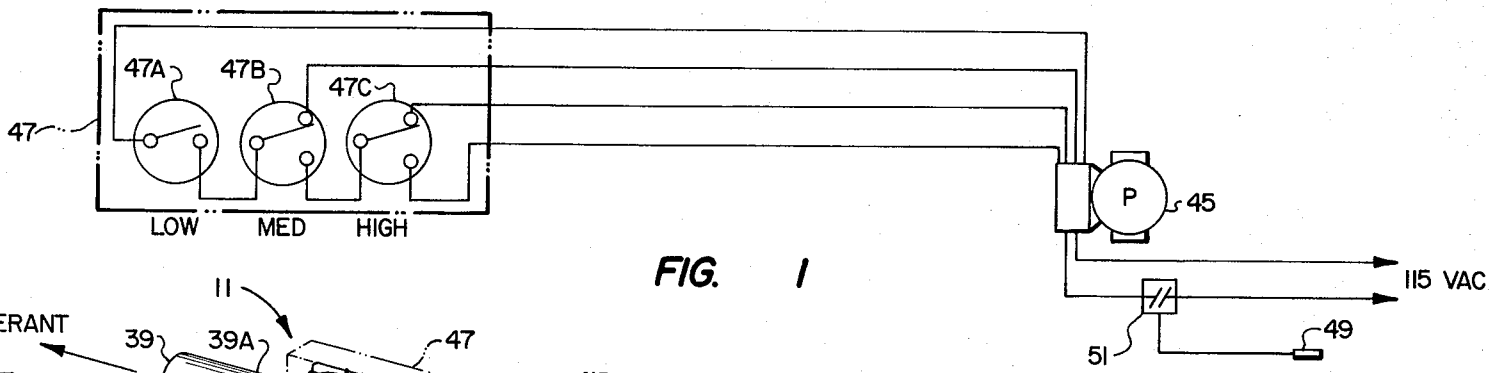
FIG. 1 is a schematic diagram of a system for controlling water flow in a heat exchange assembly embodying the invention.

The drawings show a heat exchange assembly 11 arranged to act on the refrigerant of an air conditioning system, downstream of the compressor of the air conditioning system, to cool the refrigerant prior to its delivery to the compressor and reclaim heat from the refrigerant to increase the temperature of water in a hot water supply system.

The heat exchange assembly 11 comprises an enclosure lined with one inch thick thermal insulation. Inside the enclosure are mounted three coaxial, i.e. tube-in-tube, heat exchange coils 23A, 23B and 23C which are arranged in a line with their axes coincident. Each coil

23 comprises an outer steel tube 25, tested to 450 psi pressure, and an inner, double-walled, vented copper tube 27, tested to 450 psi pressure, arranged coaxially within the outer tube 25. The double wall construction isolates the water from the refrigerant. Each coil 23 has a refrigerant-in connection pipe 29 communicating with the annular space between the outer tube 25 and the outer wall of the inner tube 27 at one end of the coil 23 and a refrigerant-out connection pipe 31 communicating with the other end of said space. Each coil 23 also has a water-in connection pipe 33 connected to one end of the inner tube 27 and a water-out connection pipe 35 connected to the other end of the tube 27.

Each refrigerant-in connection pipe 29 connects its respective coil 23 to a refrigerant-in manifold pipe 37. Likewise, each refrigerant-out connection pipe 31 connects to a refrigerant-out manifold pipe 39, each water-in connection pipe 33 to a water-in manifold pipe 41 and each water-out connection pipe 35 to a water-out manifold pipe 43. It will be appreciated from the foregoing that the three coils 23 of the heat exchange assembly are connected in parallel in both the water circulation circuit and the refrigerant circulation circuit.

Figure 2:
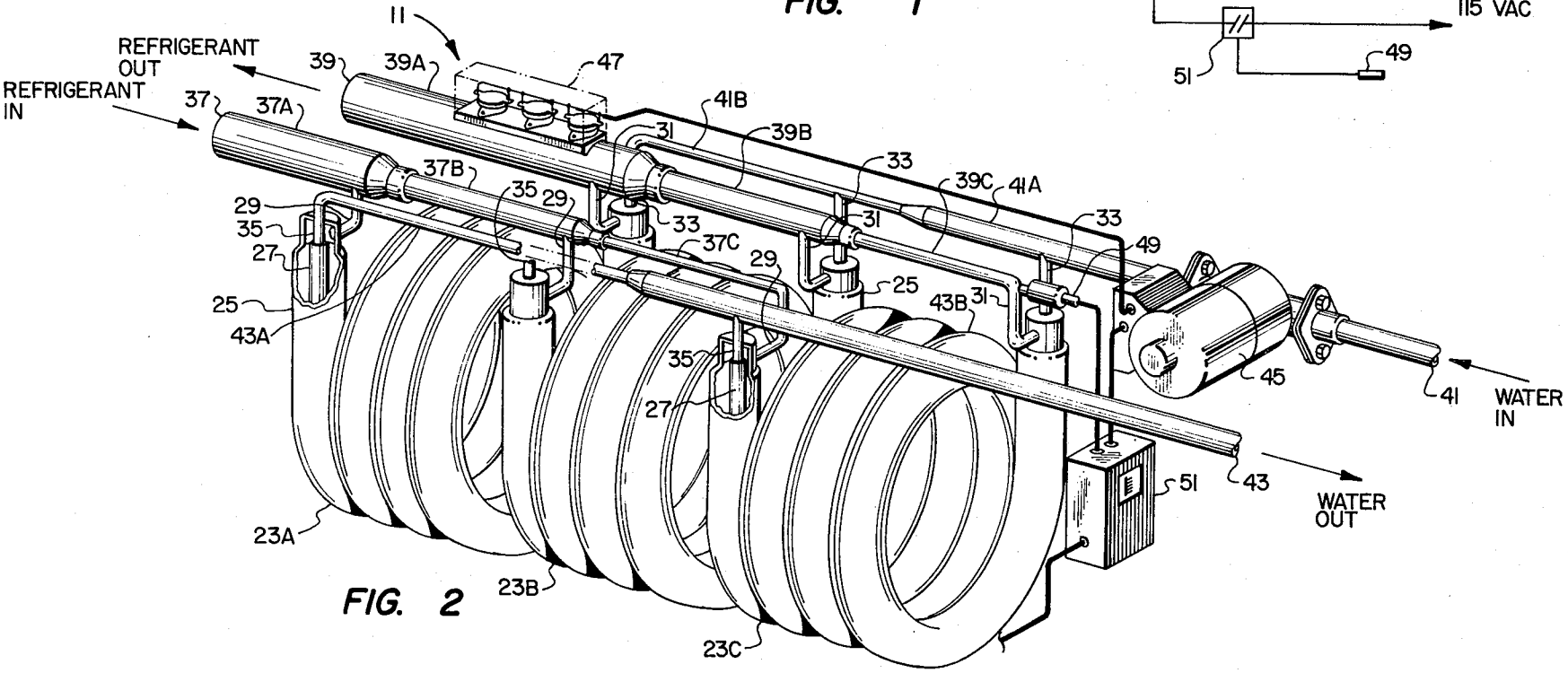
FIG. 2 is a perspective view of a heat exchange assembly for use with the system of FIG. 1.

As seen in FIG. 2, the refrigerant-in manifold pipe 37 has a large diameter section 37A terminating just downstream of the refrigerant-in connection pipe 39 leading to the coil 23A, medium diameter section 37B terminating just downstream of the refrigerant-in connection pipe 29 leading to the coil 23B and small diameter section 37C extending to the refrigerant-in connection pipe 29 for the coil 23C. Similarly, the refrigerant-out manifold pipe 39 has a small diameter portion 39C extending from the refrigerant-out connection pipe 29 of the coil 23C to a position just upstream of the point at which the refrigerant-out connection pipe 31 from the coil 23B joins the manifold pipe 39, a medium diameter portion 39B extending to a position just upstream of the point at which the refrigerant-out connection pipe 31 from the coil 23C joins the manifold pipe 39 and a large diameter portion 39A extending downstream therefrom.

FIG. 1 also shows that the water-in manifold pipe 41 has a large diameter portion 41A extending downstream to a point between the water-in connection pipes 33 leading to the coils 23B and 23C and a smaller diameter section 41B extending therefrom to the water-in connection pipe 33 to the coil 23A. The water-out manifold pipe 43 has a small diameter section 43A extending from the water-out connection pipe 35 of the coil 23A to a point between the joints of water-out connection pipes 35 and the coils 23B and 23C. A large diameter section 43B extends downstream therefrom.

The water-in manifold pipe 41 is connected at its upstream end to a circulation pump 45, which receives water from the water supply system 17. It will be seen that the water and refrigerant flow in opposite directions through the coils 23 so as to obtain maximum heat transfer between them.

The pump 45 is a single phase, multi-speed, water-lubricated pump. The speed of the pump 45 is controlled by a temperature sensitive, three speed control switch 47 which is responsively coupled to sense the temperature of the refrigerant in the refrigerant-out manifold 39 immediately downstream from the coil 23A. The switch assembly 47 includes three switch elements 47A, 47B and 47C which open and close in response to the sensed temperature to cause the pump 45 to run at low, medium and high pump speeds.

The apparatus also includes a head pressure-responsive control switch 51. This switch 51 is connected in fluid communication with the upstream end of the refrigerant-out manifold pipe 39 through probe 49 to sense the pressure of the refrigerant therein. The switch 51 responds by allowing operation of the pump 45 only if the refrigerant pressure is above a pre-set value.

FIG. 2 shows schematically the electrical wiring diagram for the pump 45, the speed-control switch 47 and the pressure-responsive control switch 51, which is connected to a source of 115 volts A.C.

In use, the variation of diameter in the refrigerant-in manifold pipe 37 and the refrigerant-out manifold pipe 39 ensures that the refrigerant has substantially equal flow rates through the three coils 23, since the variation in cross-sectional area of the pipes 37 and 39 at each stage increases the pressure in the refrigerant line by an amount which compensates for the drop in pressure caused by the flow of a portion of the refrigerant through successive coils 23.

The variation in cross-sectional areas of the water manifold pipes also contributes to a balanced assembly in which there is substantially uniform distribution of heat exchange between the three coils 23.

The heat exchange assembly described above will operate with a 25 to 30 ton A/C compressor. Based on 250–280 psi high side pressure using a suitable refrigerant, such as freon R-22, the assembly is capable of producing eight gallons per hour of hot water heated for 70 degrees Farenheit temperature rise per ton of A/C compressor rating, i.e. a 30 ton compressor will produce 240 gallons per hour when operating.

Although a preferred embodiment of the invention has been described in detail, it should be understood that various changes, substitutions, and alterations can be made therein without departing from the spirit and scope of the invention as defined by the appended claims.

What is claimed is:

1. A heat exchange assembly for reclaiming heat from the refrigerant of an air conditioning system comprising:

a water circulation means;

a refrigerant circulation means;

a plurality of tube-in-tube heat exchange coils connected in parallel in the refrigerant and water circulation means to receive refrigerant in one tube and water in the other for heat exchange therebetween; and means for ensuring a substantially equal rate of flow of refrigerant through each of the heat exchange coils, said means includes a refrigerant-in manifold pipe connecting the upstream end of the refrigerant tube of each of the coils to the refrigerant circulation circuit and a refrigerant-out manifold pipe connecting the downstream end of the refrigerant tube of each coil to the refrigerant circulation circuit, said inlet manifold pipe having successive decreases of cross-sectional area downstream of each said upstream end connection and said outlet manifold pipe having successive increases of cross-sectional area upstream of each said downstream end connection.

* * * * *